US006390234B1

(12) United States Patent
Boyer

(10) Patent No.: US 6,390,234 B1
(45) Date of Patent: May 21, 2002

(54) SHOCK ABSORBING SAFETY HARNESS

(76) Inventor: Pamela Boyer, 17931 Shoal Creek Dr., Baton Rouge, LA (US) 70810

( * ) Notice: Subject to any disclaimer, the term of this patent is extended or adjusted under 35 U.S.C. 154(b) by 0 days.

(21) Appl. No.: 09/729,116

(22) Filed: Dec. 4, 2000

Related U.S. Application Data

(63) Continuation-in-part of application No. 09/639,055, filed on Aug. 15, 2000.

(51) Int. Cl.[7] ..... A62B 35/00
(52) U.S. Cl. ..... 182/3; 182/6; 244/151 R
(58) Field of Search ..... 182/3, 4, 6, 7; 244/151 R

(56) References Cited

U.S. PATENT DOCUMENTS

| | | | | | |
|---|---|---|---|---|---|
| 1,935,339 | A | | 11/1933 | Tricau | |
| 2,987,279 | A | * | 6/1961 | Gray | 244/151 R |
| 3,444,957 | A | | 5/1969 | Ervin, Jr. | |
| 4,100,996 | A | | 7/1978 | Sharp | |
| 4,253,544 | A | * | 3/1981 | Dalmaso | 182/3 |
| 4,273,215 | A | | 6/1981 | Leggett | |
| 4,446,943 | A | | 5/1984 | Murray | |
| 4,446,944 | A | | 5/1984 | Forrest et al. | |
| 4,493,466 | A | | 1/1985 | Trenholm et al. | |
| 4,553,633 | A | | 11/1985 | Armstrong et al. | |
| 4,877,110 | A | | 10/1989 | Wolner | |
| 5,113,981 | A | | 5/1992 | Lantz | |
| 5,205,803 | A | | 4/1993 | Zemitis | |
| 5,209,702 | A | | 5/1993 | Arenas | |
| 5,287,943 | A | | 2/1994 | Bell | |
| 5,487,444 | A | | 1/1996 | Dennington | |
| 5,598,900 | A | | 2/1997 | O'Rourke | |
| 5,738,046 | A | | 4/1998 | Williams et al. | |
| 5,878,833 | A | * | 3/1999 | Bell | 182/3 |
| 5,915,789 | A | | 6/1999 | Ponce De Leon | |
| 6,006,700 | A | | 12/1999 | Cox | |
| 6,032,758 | A | | 3/2000 | May | |
| 6,125,475 | A | * | 10/2000 | Taylor | 182/3 |

* cited by examiner

*Primary Examiner*—Alvin Chin-Shue
(74) *Attorney, Agent, or Firm*—Keaty Professional Law Corporation

(57) ABSTRACT

The safety harness assembly has a body harness securable on the user's torso. Shoulder straps of the body harness are provided with non-stretchable sleeves enclosing an insert with limited stretching capabilities that provide shock-absorption during an accidental fall. The length of the sleeve is greater than that of the insert in a normal, non-stretched mode. If the user falls, the insert stretches to the maximum length of the enclosing sleeve, distributing forces to the leg and breast straps of the harness. The shoulder straps slide through a floating O-ring and are fixedly secured to a D-ring in the back of the harness. A lanyard with limited stretching capabilities is fixedly secure to the O-ring and the D-ring. The three-point safety shock-absorbing harness allows retaining the user in a vertical position during an accidental fall.

19 Claims, 2 Drawing Sheets

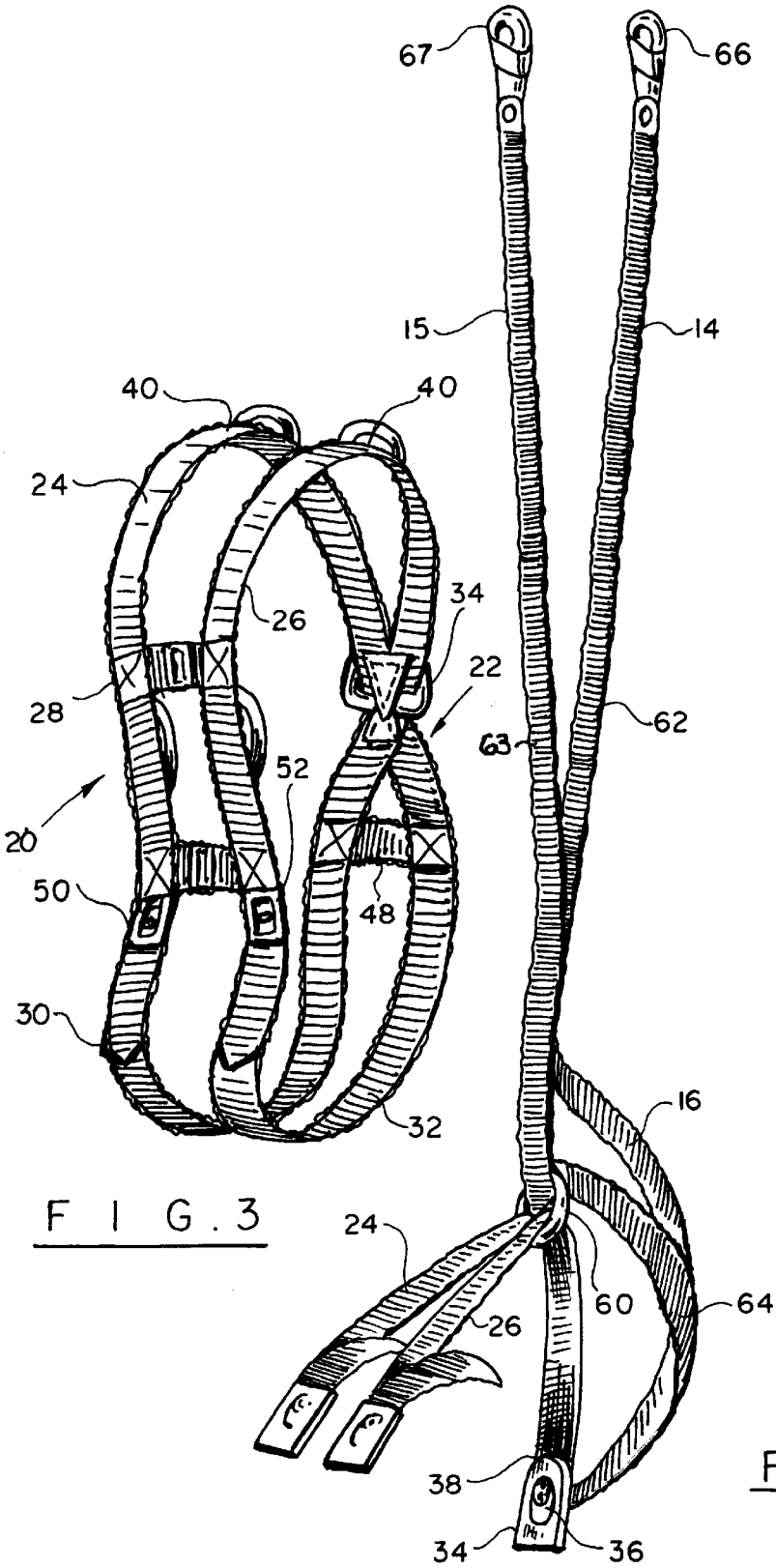
FIG. 3
FIG. 4
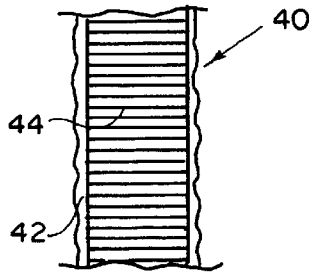
FIG. 5

SHOCK ABSORBING SAFETY HARNESS

CROSS-REFERENCE TO RELATED APPLICATIONS

This application is a continuation-in-part of my co-pending application Ser. No. 09/639,055 filed on Aug. 15, 2000 for "Safety Harness," the full disclosure of which is incorporated by reference herein.

BACKGROUND OF THE INVENTION

The invention relates to a safety harness for use in industrial and recreational environments, and in particular to a safety harness that absorbs a shock when a person wearing the harness falls from an elevated structure.

Many industries require the use of a harness when the worker is employed on an elevated structure, such as scaffolding, oil rig, pipelines, construction sites and the like. The harness is connected to a lanyard, one end of which is fastened to the harness and the other end to a stable structure, such as a scaffold. Each harness must meet set requirements designed for protecting the workers in case of a fall. For example, one of the requirements is that the harness meets ANSI Z 3:59 standard, which is a 6 foot drop with 220 pounds, not to exceed 1,800 pounds of force, taking into account the force and speed of the fall from an elevated position.

Conventional harnesses include at least a belt which encircles the torso of the user and shoulder straps that cross in the back, wherein a D-ring or other similar lanyard attachment member is positioned. The harness straps are conventionally made of nylon webbing or leather; these straps do not stretch and have negligible resiliency. Conventional lanyards are made of cords or ropes; they are also non-resilient, providing little shock-absorbing qualities to the harness.

When a user falls and the lanyard reaches its outermost extension, the speed of decent is sharply interrupted. The shock of the abrupt interruption applies a considerable pressure on the bone structure and internal organs of the user. Another disadvantage attributable to conventional harnesses is positioning of the lanyard in the back of the harness, usually close to the waistline of the user's back. When the user falls, he usually descends with his face down; dangling in the harness, suspended by the lanyard in a position that imposes considerable pressure on the user's abdomen.

In other cases, the user's fall is interrupted by the maximum extension of the lanyard and the user assumes a generally horizontal position. This almost horizontal position is also dangerous because the user may accidentally hit the adjoining structure, such as the wall of the building or the scaffolding, causing injury to the head or the limbs.

The industry has attempted to solve this problem by providing improvements to industrial harnesses, one of which is disclosed in U. S. Pat. No. 5,487,444 issued on Jan. 30, 1996. In that patent, the safety harness includes a resilient, elastomeric cord assembly connected to the backside of the harness and the end portion of the harness. The two portions of the cord assembly connect to a safety fail-safe lanyard. The cord and the lanyard create a three-point support system to absorb the shock of the fall and help retain the person in an upright position. The fail-safe lanyard acts as a back up in case of a failure of the elastomeric cord assembly. The lanyard and the fail-safe lanyard are made from a non-stretchable material.

While the safety harness in accordance with the '444 patent is an improvement over prior safety harnesses, there is still room for improvement, particularly in the area of shock-absorption. The present invention contemplates provision of a safety harness with enhanced shock-absorbing capabilities.

SUMMARY OF THE INVENTION

It is, therefore, an object of the present invention to provide a safety harness that is suitable for use in industrial and recreational environments.

It is another object of the present invention to provide a shock absorbing safety harness that is constructed as one unit.

It is a further object of the present invention to provide a shock absorbing safety harness that is lightweight, comfortable to use, while being strong and reliable.

It is still a further object of the present invention to provide a safety harness with improved shock-absorbing properties that lessens shock load and shortens the distance of the fall keeping the individual from injury.

These and other objects of the present invention are achieved through a provision of a safety harness that comprises a body harness assembly and a shock-absorbing suspender lanyard with pre-determined limited extension capabilities. The suspender lanyard is fixedly attached to the body harness. The shoulder straps of the body harness are provided with shock-absorbing capabilities, similar to the suspender assembly, allowing a limited extension of the shoulder straps in case of an accidental fall. The shoulder straps are attached to a breast strap or extend below the breast strap to a pair of leg, or thigh straps. An optional waist belt is provided.

The shoulder straps pass through a floating O-ring, to which the lanyard is fixedly secured allowing vertical position when falling. A D-ring positioned below the O-ring serves as a mutual fixing point for the shoulder straps and the end of the lanyard. A back-up lanyard is secured between the O-ring and the D-ring.

BRIEF DESCRIPTION OF THE DRAWINGS

Reference will not be made to the drawings wherein like parts are designated by like numerals and wherein

FIG. 3 is a perspective view of the safety harness of the present invention without a suspender lanyard.

FIG. 4 is a detail perspective view of the shoulder straps and the lanyard assembly of the safety harness in accordance with the present invention.

FIG. 5 is a detail view of the shock-absorbing band of the safety harness.

DETAIL DESCRIPTION OF THE PREFERRED EMBODIMENT

Figure 1:
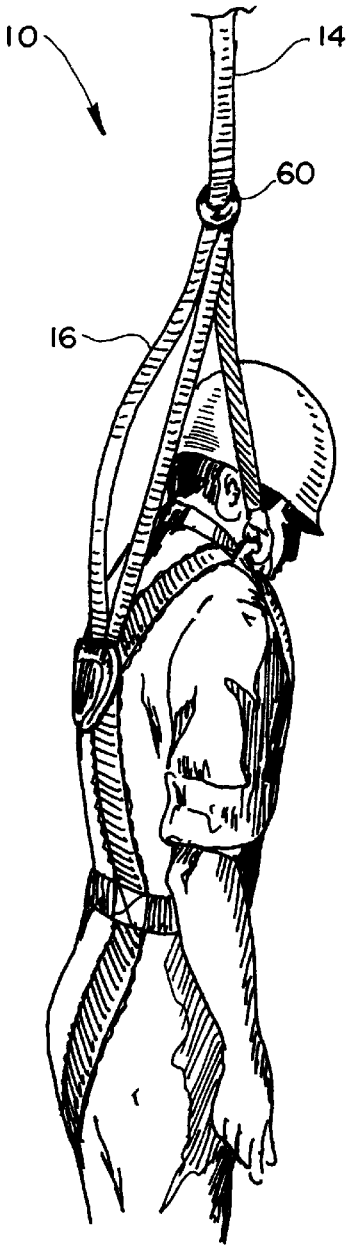
FIG. 1 is a perspective view of the safety harness in accordance with the present invention, showing a user suspended during a fall.
Figure 2:
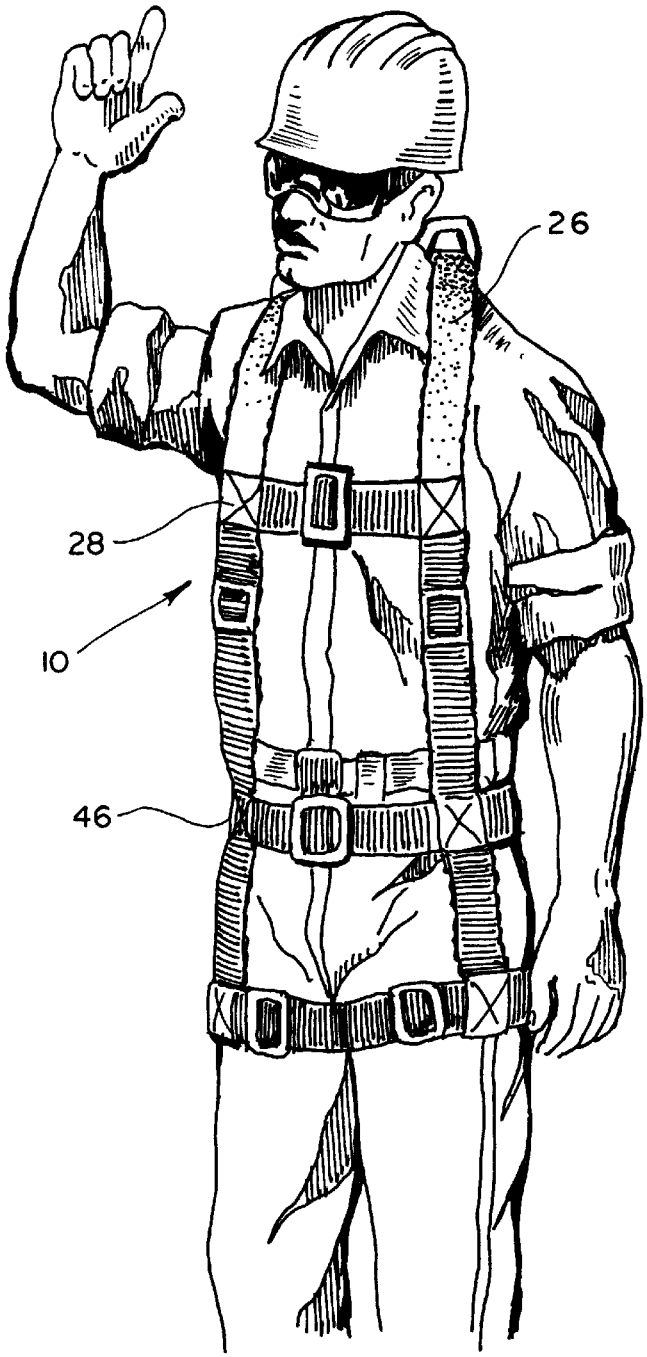
FIG. 2 is a perspective view of the safety harness in accordance with the present invention with an optional waist belt, as worn by a user during normal activities.

Referring now to the drawings in more detail, numeral 10 designates the shock absorbing safety harness in accordance with the present invention. The safety harness 10 comprises a body harness 12 adapted for positioning on the user's torso, at least one shock-absorbing suspender lanyard, or band 14 (and 15 if a double-lanyard is used) and a back-up shock-absorbing lanyard, or band 16.

The body harness 12 has a front side 20 and a backside 22. The body harness 12 comprises a pair of shoulder straps 24 and 26, and a pair of leg straps 30 and 32. The shoulder straps 24 and 26 terminate at the breast strap 28, where each strap 24, 26 forms a loop that is sewn to the breast strap 28, as shown in FIG. 3.

The right shoulder strap 24 and the left shoulder strap 26 extend over the shoulders of the user and cross in the back, wherein they are fixedly attached to a bottom slot 36 of a D-ring 34. The D-ring 34 secures the shoulder straps together and forms a receiving member for the lanyards 14 and 15, which are attached to the D-ring through the top opening 38, as shown in more detail in FIG. 4. When the harness 10 is worn by a user, the D-ring 34 is stationary, it is situated in the middle of the back of the user. When the user is suspended in the harness 10, the D-ring 34 will move upwardly, toward the shoulder blades of the user.

The shoulder straps 24, 26 and the lanyards 14, 15 are formed from a shock-absorbing band 40. The band 40, shown in more detail in FIG. 5, comprises a flexible, deformable non-stretchable tubular sleeve 42 and a non-resilient stretchable insert 44. The insert 44 has limited stretching capabilities. The sleeve 42 is gathered, accordion-style enclosing the insert 44. The length of the sleeve, in a non-gathered state is made to approximately equal anticipated length of the insert 44 when the insert 44 is stretched to its maximum length, the importance of which will be discussed in more detail hereinafter.

The remainder of the straps, that is the leg straps 30, 32 the breast strap 28 and an optional waist belt 46 are formed from nylon webbing, leather, and other similar flexible non-stretchable material. If desired, a connecting strap 48 may be provided in the back of the harness 12 below the D-ring 34. The connecting strap 48 helps to keep the back straps together during use. The connecting strap, if provided, is fixedly attached, such as by stitching, to the straps below the D-ring 34.

After crossing in the back at the junction with the D-ring 34 and below the attachment to the connecting strap 48, the shoulder straps 24 and 26 continue to become thigh, or leg straps 30 and 32, forming loops for receiving legs of the user. At the front, the leg straps 30 and 32 are provided with adjustment members, or buckles 50 and 52, respectively. The buckles 50 and 52 may be friction buckles, or other type of fastener elements. By pulling the free ends of the straps 30 and 32, the user can adjust the length of the loops formed by the leg straps 30 and 32 to snugly encircle the legs or thighs of the user.

Turning now to FIG. 4, the shoulder straps 24, 26 are seen passing through a floating O-ring 60 positioned above the D-ring 34. The lanyards 14 and 15 are fixedly attached to the O-ring 60, creating upper portion 62,63 above the O-ring 60 and lower portion 64, 65 (only one is shown in FIG. 4) that stretches between the O-ring 60 and the D-ring 34.

The back-up suspender lanyard 16 (FIGS. 1 and 4) is fixedly attached between the O-ring 60 and the D-ring 34. The back-up lanyard 16 is longer than the portion 64 of the lanyards 14 and 15 and is made from the same material as that shown in FIG. 6, similar to the shoulder straps 24, 26 and the suspender lanyards 14, 15. If desired, the back-up lanyard 16 may be made from a highly elastomeric, resilient material that will provide extra stretching to the harness in case of emergency.

The fail-safe secondary lanyard, or back-up lanyard 16 prevents excessive stretching of the shock-absorbing cords during a fall and limits the length, to which the cords are stretched. While the suspender portion 64 stretches, the portion 64 will be limited in its extension by the length of the secondary lanyard 16.

When in use, the harness 10 can secure the user's shoulders, thighs, and mid-section. A free end of each lanyard 14, 15 is secured to a stationary structure, such as scaffolding, tree and the like by snap hooks 66, 67, respectively. If the user falls, the first shock-absorbing force is provided by the shoulder straps 24 and 26.

The O-ring 60 slides upwardly, suspending the user by the shoulder straps in a generally vertical position as shown in FIG. 1. As a result, the harness of the present invention allows the user to remain in a vertical position and not to swing, head first, toward solid structures, such as walls of buildings, trees and the like.

The suspender lanyard 14, 15 and the shoulder straps 24, 26 stretch to a limited degree until the insert 42 inside the sleeve 42 reaches its maximum extension. It is possible that the portions 64, 65 do not reach their maximum extension when the fall terminates and the user becomes suspended. However, if the maximum extension is reached for the portion 64, 65 and the fall continues, or the weight of the user exerts an excessive force on the suspender lanyard 14, the back-up band 16 comes into action, stretching, to some degree and continuing the shock-absorbing function of the harness 10. While the shoulder straps 24, 26 and the lanyards 14, 15 stretch under the gravity force, they transmit the load to the breast strap 28 and the leg straps 30, 32, decreasing the shock imposed by the fall on the user's body.

In this manner, the user remains in a generally vertical position, which is particularly important if the user becomes unconscious. The distributed shock of the fall protects the internal organs and the rib cage of the user, preventing a severe injury.

The harness 10 may be provided with optional loops on the straps 24, 26, 30 and 32 for attachment of other harness members or connectors. The connectors may be used for attaching a seat belt (not shown), or tool belts to facilitate work of the user. The lanyards 14, 15 are long enough not to impede natural movements of the user during work or recreational activity. If desired, the lanyard may be made from one suspender lanyard 14, which will connect to the O-ring 60 and the D-ring 34 in a similar manner as a double lanyard. It is envisioned that the harness 10 may be manufactured in different sizes to accommodate larger persons, although normally small and large size versions should be sufficient.

The leg straps 30, 32, breast strap 38 and connector strap 48 are made from nylon webbing, for example 2 inch by 16 inch fine weave nylon webbing having up to 6,000 pounds tensile strength for each strap. The waist strap, if provided, may be double layered to allow for tool pouches or other slide-on attachments. To make the connection points more secure, a multi pass "box-x" stitch pattern is used at connection points of the harness straps.

The safety harness of the present invention is designed to comply with and exceed the standards of the American National Standards Institute for safety. The harness hardware, that is the buckles and rings of the safety harness may be manufactured from steel or from lightweight plastic, so as to make the safety harness more comfortable to use.

The sleeve 42 and the straps 30, 32, 28 and 48 may be manufactured from camouflage-patterned fabric to make the harness 10 more attractive during hunting. It is also envisioned that the straps may also have a camouflage-patterned coating on the exterior surfaces thereof that duplicate the camouflage pattern of the hunting attire to make the user less visible outdoors.

The lanyard, or suspender lanyard 14 and 15 along almost their entire length provide increased resistance to impact under load. The load is expected not to exceed 1800 pounds. Each layer of lanyard webbing has a minimum of 5000 pounds tensile strength, with a total of 10,000 pounds for double lanyard. The lanyard may be sewn directly to the D-ring of the harness or it may be detachable with a snap hook attachment. It can be removed at the factory for replacement if worn out or cracked.

The three-point connection of the shock-absorbing assembly significantly reduces the impact force of the fall and swing. The user remains in a vertical position, as shown in FIG. 1, when suspended by the lanyard. The stretchable material integrated with the harness shoulder straps allows for slower deceleration without significant extension of the lanyard length during fall. It is possible to provide stretchable band with various stretching capabilities for shoulder straps, for lanyard and for the back-up lanyard. For instance, the lanyard may have less stretching capabilities than the shoulder straps, slowing the fall with greater force. Similarly, the back-up lanyard, which will serve as the last line of defense, will stretch even slower, thus affording greater protection to the user.

Many changes and modifications can be made in the design of the present invention without departing from the spirit thereof. I, therefore, pray that my rights to the present invention be limited only by the scope of the appended claims.

What is claimed is:

1. A safety harness, comprising:

a body harness assembly positionable on a user's body, the body harness assembly comprising a left shoulder strap and a right shoulder strap, said shoulder straps crossing in the back, while sliding through a floating O-ring;

a suspender assembly having a first upper branch and a second lower branch, the first branch being fixedly attached to the floating O-ring; and a lanyard securing member positioned centrally with respect to the left shoulder strap and the right shoulder strap on a back side of the body harness, the second branch of the suspender assembly being fixedly attached to the lanyard securing member.

2. The device of claim 1, wherein each said left shoulder strap, said right shoulder strap and said suspender assembly each have limited stretching capabilities.

3. The device of claim 2, wherein each said left shoulder strap, said right shoulder strap and said suspender assembly comprise a stretchable member enclosed in a non-stretchable sleeve, said non-stretchable sleeve having a greater longitudinal dimension than said stretchable member.

4. The device of claim 3, wherein said sleeve is gathered lengthwise to generally correspond in length to a longitudinal dimension of said insert, said sleeve extending when the insert is stretched during an accidental fall of a user.

5. The device of claim 1, wherein said body harness further comprises a breast strap for connecting the left shoulder strap and the right shoulder strap at a front side of the harness.

6. The device of claim 1, wherein said left shoulder strap is unitary connected to a left leg strap and said right shoulder strap is unitary connected to a right leg strap.

7. The device of claim 6, wherein said body harness comprises a back connecting member secured between the left leg strap and the right leg strap on the back side of the harness below said lanyard securing member.

8. The device of claim 1, wherein said lanyard securing member is a D-ring having an upper opening and a lower opening, and wherein said suspender assembly is fixedly attached to the D-ring through the upper opening, while the right should strap and the left shoulder strap are fixedly attached to the D-ring through the lower opening.

9. A safety harness, comprising:

a body harness assembly positionable on a user's body, the body harness assembly comprising a left shoulder strap and a right shoulder strap, said shoulder straps crossing in the back, while sliding through a floating O-ring, each said right shoulder strap and said left shoulder strap having limited stretching capabilities;

a lanyard assembly having a first upper branch and a second lower branch, the first branch being fixedly secured to the floating O-ring;

a lanyard securing member positioned centrally with respect to the left shoulder strap and the right shoulder strap on a back side of the body harness, the lower branch of said lanyard assembly being fixedly attached to said lanyard securing member;

a right leg strap and a left leg strap being unitary connected to respectively the right shoulder strap and the left shoulder strap and extending from front side to the back side of the harness; and a breast strap secured between front portions of said left shoulder strap and said right shoulder strap.

10. The device of claim 9, wherein said lanyard securing member is a D-ring having an upper opening and a lower opening, and wherein said lanyard assembly is fixedly attached to the D-ring through the upper opening, while the right should strap and the left shoulder strap are fixedly attached to the D-ring through the lower opening.

11. The device of claim 9, wherein said lanyard assembly comprises at least one lanyard having limited stretching capabilities.

12. The device of claim 10, wherein each said at least one lanyard, said left shoulder strap and said right shoulder strap comprise a stretchable member enclosed in a non-stretchable sleeve, said non-stretchable sleeve having a greater longitudinal dimension than said stretchable member.

13. The device of claim 12, wherein said sleeve is gathered lengthwise to generally correspond in length to a longitudinal dimension of said insert, said sleeve extending when the insert is stretched during an accidental fall of a user.

14. The device of claim 9, wherein said body harness comprises a back connecting member secured between the left leg strap and the right leg strap on the back side of the harness below said lanyard securing member.

15. A safety harness, comprising:

a body harness assembly positionable on a user's body, the body harness assembly comprising a left shoulder strap and a right shoulder strap, said shoulder straps crossing in the back, while sliding through a floating O-ring, each said right shoulder strap and said left shoulder strap having limited stretching capabilities;

a lanyard assembly having a first upper branch and a second lower branch, the first branch being fixedly secured to the floating O-ring;

a lanyard securing member positioned centrally with respect to the left shoulder strap and the right shoulder strap on a back side of the body harness, wherein the lower branch of said lanyard assembly, said right shoulder strap and said left shoulder strap each being fixedly attached to said lanyard securing member;

a right leg strap and a left leg strap being unitary connected to respectively the right shoulder strap and the left shoulder strap and extending from front side to the back side of the harness; and a breast strap secured between front portions of said left shoulder strap and said right shoulder strap.

16. The device of claim 15, wherein said lanyard assembly comprises at least one lanyard having limited stretching capabilities.

17. The device of claim 16, wherein each said at least one lanyard, said left shoulder strap and said right shoulder strap comprise a stretchable member enclosed in a non-stretchable sleeve, said non-stretchable sleeve having a greater longitudinal dimension than said stretchable member, and wherein said sleeve is gathered lengthwise to generally correspond in length to a longitudinal dimension of said insert, said sleeve extending when the insert is stretched during an accidental fall of a user.

18. The device of claim 15, wherein said lanyard securing member is a D-ring having an upper opening and a lower opening, and wherein said lanyard assembly is fixedly attached to the D-ring through the upper opening, while the right should strap and the left shoulder strap are fixedly attached to the D-ring through the lower opening.

19. The device of claim 15, wherein said body harness comprises a back connecting member secured between the left leg strap and the right leg strap on the back side of the harness below said lanyard securing member.

* * * * *